US005416953A

United States Patent [19]

Hui

[11] Patent Number: 5,416,953

[45] Date of Patent: May 23, 1995

[54] WRIST WATCH AND WRIST WATCH STRAP

[75] Inventor: Wah-Sang Hui, Shatin, Croatia

[73] Assignee: E. Gluck Corporation, Long Island City, N.Y.

[21] Appl. No.: 25,438

[22] Filed: Mar. 3, 1993

[51] Int. Cl.[6] ..... A44C 5/14

[52] U.S. Cl. ..... 24/265 WS; 24/265 B; 368/282; 224/164

[58] Field of Search ..... 24/265 B, 265 WS, 652, 24/656; 224/177, 164; 368/282

[56] References Cited

U.S. PATENT DOCUMENTS

| | | | |
|---|---|---|---|
| 1,194,484 | 8/1916 | Depollier et al. | 24/265 B |
| 1,569,507 | 1/1926 | Lederer | 24/265 B |
| 3,259,283 | 7/1966 | Moinat | 24/265 WS |
| 3,824,783 | 7/1974 | Nadeau | 24/265 B |
| 3,939,534 | 2/1976 | Hayes . | |
| 4,149,662 | 4/1979 | Ramaciere . | |
| 4,234,115 | 11/1980 | Williams . | |
| 4,564,308 | 1/1986 | Ikegami et al. . | |

FOREIGN PATENT DOCUMENTS

| | | |
|---|---|---|
| 832960 | 4/1960 | United Kingdom . |
| 1345949 | 2/1974 | United Kingdom . |
| 2037570 | 7/1980 | United Kingdom . |

*Primary Examiner*—Edward K. Look
*Assistant Examiner*—James A. Larson
*Attorney, Agent, or Firm*—Douglas P. Dreyer

[57] ABSTRACT

A wrist watch (1) and wrist watch strap combination (2, 3) includes a manually operable securing mechanism for securing the wrist watch to the wrist watch strap to allow easy removal and replacement of the strap. The mechanism may comprise links (4) on the wrist watch and on the strap which may be interlinked with one another.

9 Claims, 2 Drawing Sheets

WRIST WATCH AND WRIST WATCH STRAP

BACKGROUND OF THE INVENTION

The present invention relates to wrist watches and to wrist watch straps. The term "strap" in this context includes all devices for holding a wrist watch in position on the wrist including not only straps made of leather or plastic but also metal bracelets, hereinafter for convenience all referred to as "straps".

Traditionally watch straps are secured to wrist watches in a manner such that it is difficult to remove the strap from the watch, for the purpose of changing the strap or repairing the watch. A hand tool or instrument is generally required to remove the strap from the watch and to secure the same or a different strap to the watch.

SUMMARY OF THE INVENTION

The invention provides a wrist watch and a wrist watch strap combination including a securing mechanism for securing the wrist watch strap to the wrist watch, the securing mechanism being manually operable so that the wrist watch and wrist watch strap can be secured to one another or released from one another without the use of any instrument.

In a preferred construction in accordance with the invention the securing mechanism for attaching one end of the strap to the wrist watch comprises a link or eye on the strap which may be interlinked with a link or eye on the wrist watch, one of the links including a spring loaded catch to allow interlinkage.

The invention allows the user to easily remove or change a wrist watch strap as and when required, for reasons of fashion, to facilitate repairing the wrist watch, or because a strap has become worn out.

The invention will now be described more particularly with reference to the accompanying drawings which show, by way of example, a wrist watch provided with a pair of links each having a spring loaded catch in use in combination with two different wrist watch straps each provided with closed links at the ends thereof.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
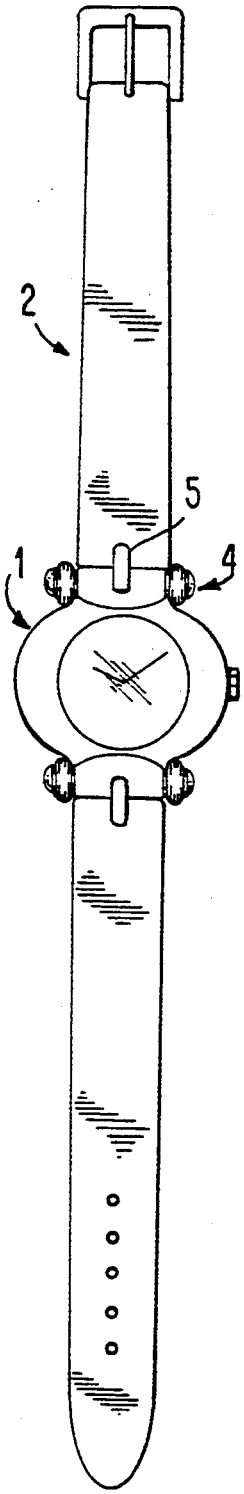
FIG. 1 shows a wrist watch and leather strap combination.

FIGS. 1, 2, 3 and 4 show a wrist watch 1, a leather strap 2, and a metal bracelet 3. The wrist watch 1 includes links 4 for cooperating with links 5 on the leather strap 2 or metal bracelet 3.

Figure 5:
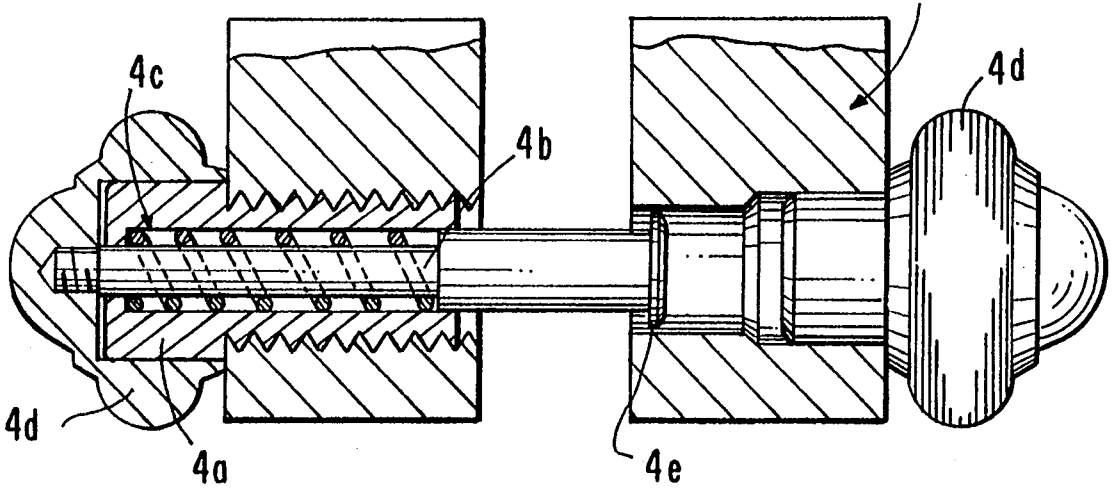
FIG. 5 is a sectional elevation of a spring loaded catch.

FIG. 5 shows a link 4 in more detail. The link 4 includes a fixed cylinder 4*a*, a piston 4*b* moveable along cylinder 4*a*, a compression coil spring 4*c* located within the cylinder 4*a* and a handle 4*d* for use in retracting the piston 4*b* into the cylinder 4*a* against the action of the spring 4*c* so as to thereby open the link. The piston (shaft) 4*b* includes a flange 4*e*, which abuts against the watch case when retracted.

Figure 2:
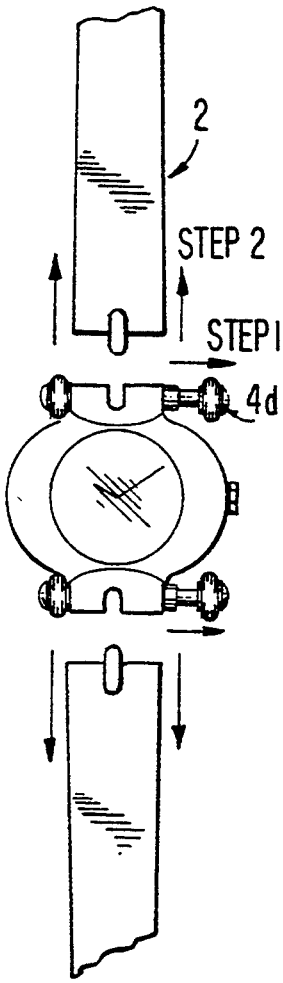
FIG. 2 shows the removal of the leather strap from the wrist watch.
Figure 3:
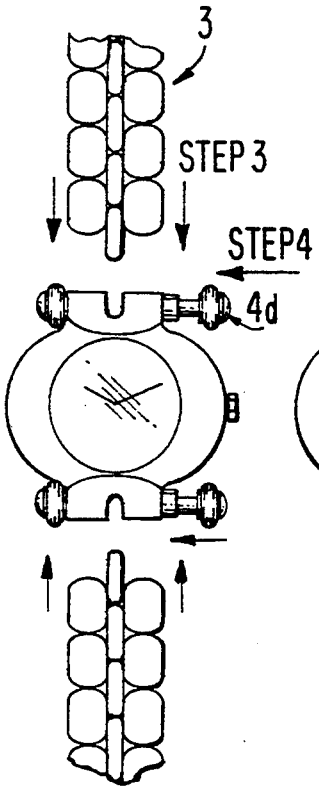
FIG. 3 shows the attachment of a metal bracelet to the wrist watch.
Figure 4:
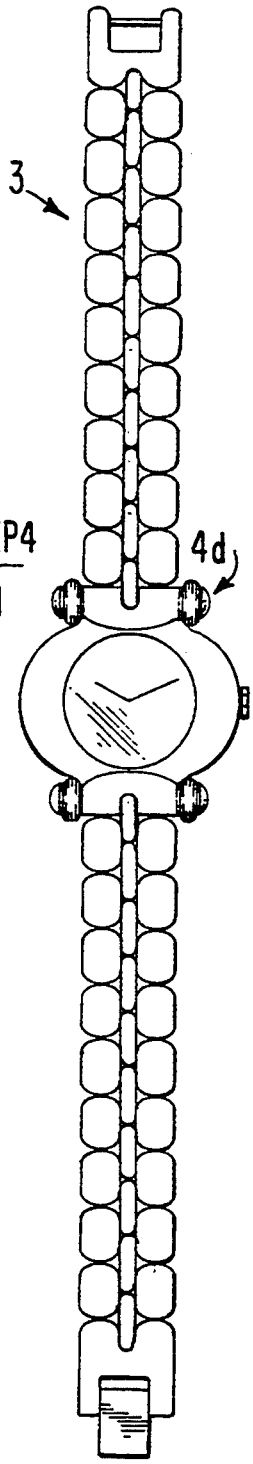
FIG. 4 shows the wrist watch and metal bracelet combination.

Referring back to FIGS. 1, 2, 3 and 4, FIG. 1 shows the wrist watch 1 and leather strap 2 connected together. In FIG. 2 the handles 4*d* have been manually retracted and the leather strap 2 has been disconnected from the wrist watch 1. In FIG. 3 the handles 4*d* are still retracted and metal bracelet 3 is about to be secured to the wrist watch 1. In FIG. 4 the metal bracelet 3 is shown attached to the wrist watch 1.

From a consideration of FIGS. 1, 2, 3 and 4 it will be seen that the preferred construction is simple to operate, and is also aesthetically pleasing, and does not greatly add to the size or weight of the watch, so that the watch is comfortable for the wearer.

What is claimed is:

1. A wrist watch assembly, comprising:

a wrist watch strap including an eye extending from the wrist watch strap;

a watch case defining a groove sized to receive the eye of said wrist watch strap; and means for selectively connecting said wrist watch strap to said watch case comprising a pin captive to said watch case and slidable from a first lateral position within said groove to a second lateral position outside of said groove in order to selectively release said eye from said groove.

2. The wrist watch assembly of claim 1, wherein said pin includes a head and a shaft.

3. The wrist watch assembly of claim 2, wherein said connecting means includes biasing means for biasing said shaft of said pin into said groove.

4. The wrist watch assembly of claim 3, wherein said biasing means is a helical spring.

5. The wrist watch assembly of claim 3, wherein said shaft is sized to be received within said eye of said wrist watch strap.

6. The wrist watch assembly of claim 2, wherein said shaft includes a first end integral with said head and a second end having a flange.

7. The wrist watch assembly of claim 6, wherein said watch case includes a laterally extending bore sized to receive the shaft of said pin therein.

8. The wrist watch assembly of claim 7, wherein the head of said pin abuts against the watch case proximate the bore when in the first lateral position, and the flange of the shaft of the pin abuts against the watch case proximate the bore when in the second lateral position.

9. A method of decoupling and coupling a wrist watch case and wrist watch strap, wherein said wrist watch strap includes an eye and said wrist watch case includes a groove sized to receive the eye of the wrist watch strap, and a pin having a head and a shaft and being captive to said wrist watch case and biased into said groove, said method comprising the steps of:

displacing said pin, such that said shaft is not within said groove;

removing a first said eye of a first said wrist watch strap from within said groove;

inserting a second said eye of a second said wrist watch strap into said groove; and returning said pin to said biased position.

* * * * *